United States Patent [19]

Johnston et al.

[11] 4,175,220

[45] Nov. 20, 1979

[54] CONVERTIBLE SELECTOR SWITCH

[75] Inventors: Robert J. Johnston, Patterson Heights; Stephen G. Layciak, Brighton Township, Beaver County; Stephen S. Dobrosielski, Beaver, all of Pa.

[73] Assignee: Westinghouse Electric Corp., Pittsburgh, Pa.

[21] Appl. No.: 858,323

[22] Filed: Dec. 7, 1977

[51] Int. Cl.[2] ..... H01H 3/00; H01H 9/00

[52] U.S. Cl. ..... 200/4; 74/527; 200/16 A; 200/17 R; 200/18; 200/153 L; 200/291

[58] Field of Search ..... 200/16 A, 17 R, 18, 200/153 L, 153 LA, 291, 307, 313, 314, 316, 330, 336, 4; 74/527

[56] References Cited

U.S. PATENT DOCUMENTS

| | | | |
|---|---|---|---|
| 2,498,614 | 2/1950 | Tregoring | 200/4 |
| 2,631,203 | 3/1953 | Mekelburg | 200/153 L X |
| 2,748,208 | 5/1956 | Koertge | 200/153 L X |
| 3,118,026 | 1/1964 | Pusch et al. | 200/16 |
| 3,142,187 | 7/1964 | Kane et al.. | |
| 3,169,406 | 2/1965 | Mullen | 200/153 L X |
| 3,320,393 | 5/1967 | Sohns et al. | 200/316 |
| 3,333,079 | 7/1967 | Michaelson, Jr. | 200/336 |
| 3,517,570 | 6/1970 | Kolb | 74/527 |
| 3,770,926 | 11/1973 | Wanner | 200/336 X |
| 3,919,506 | 11/1975 | Kellogg | 200/16 A |
| 3,983,348 | 9/1976 | Kellogg | 200/314 |
| 4,000,382 | 12/1976 | Kolb | 200/153 L X |

*Primary Examiner*—James R. Scott
*Attorney, Agent, or Firm*—L. P. Johns

[57] ABSTRACT

A rotary selector switch characterized by a rotatable switch actuator and at least two switch structures, the actuator having a shaft on which a handle is detachably mounted for operation in a plurality of modes to operate the switch structures in different combinations of open and closed conditions, the handle being detachably mounted on the shaft for rotating a cam through one limited sector thereof, the handle being repositionable on the shaft for rotation through another limited sector thereof, and the handle being rotatable between a pair of spaced ribs on the switch housing.

9 Claims, 24 Drawing Figures

2 MODE

3 MODE

4 MODE

CONVERTIBLE SELECTOR SWITCH

CROSS-REFERENCE TO RELATED APPLICATIONS

This application is related to copending applications of W. J. Kellogg, Ser. No. 858,326, filed Dec. 7, 1977, and R. J. Johnston, et al., Ser. No. 858,325, filed Dec. 7, 1977 and R. J. Johnston, et al. Ser. No. 858,324, filed Dec. 7, 1977. Now U.S. Pat. No. 4,136,924.

BACKGROUND OF THE INVENTION

1. Field of the Invention

This invention relates generally to electric control switches, and more particularly, it pertains to switches operative in a plurality of modes.

2. Description of the Prior Art

Most selector switches of prior construction have been used for varying contact operating modes for which purpose they are provided with different operating parts for each sequence or mode. Some switch units, for example, comprise a single contact arrangement which is convertible from a two to a three-mode unit. A disadvantage of such switches is the necessity of stocking additional parts for each contact mode. An example of a control switch operator is disclosed in U.S. Pat. No. 3,169,406, issued Feb. 16, 1965, to J. H. Mullen.

SUMMARY OF THE INVENTION

In accordance with this invention, a rotary selector switch is provided which comprises a rotatable actuating unit and at least two switch structures, a tubular housing, said unit comprising an actuator within the housing and a switch handle on one end of the actuator, the handle being at one end of the housing and rotatable through one limited sector thereof, the handle being removable from the actuator for repositioning thereon in another limited sector of rotation, a detent cam on the housing and spring bias means for holding the cam against a cam follower on the actuator, stop means for limiting rotation of said unit and comprising interengageable means between the housing and the handle, mutually interfitting means on the handle and the actuator to enable said removal and repositioning, interfitting means being more proximate to each other for rotation of the handle through one limited sector than for another sector, the interengageable means comprising at least two ribs on the housing, each rib having a stop surface on each side thereof and a peripheral spacing between the stop surface of the two ribs on one side being longer than the peripheral spacing between the stop surfaces of the two ribs on the other side thereof, the interengaging means on the handle being located in the longer peripheral spacing when the handle is rotated through said one limited sector and located in the shorter peripheral spacing when the handle is rotated through said other limited sector, an operating cam on the other end of the actuator, each switch structure having a reciprocable contact operating member to effect opening and closing of the circuit through the switch structure, and the operating having cam operating surface means for actuating the contact operating members.

The advantage of the rotatable selector switch of this invention is that it is adapted for use in two, three, or four modes by simply placing the operating handle in alternate positions and changing a cam to obtain the proper switching sequence.

DESCRIPTION OF THE PREFERRED EMBODIMENTS

Figure 1:
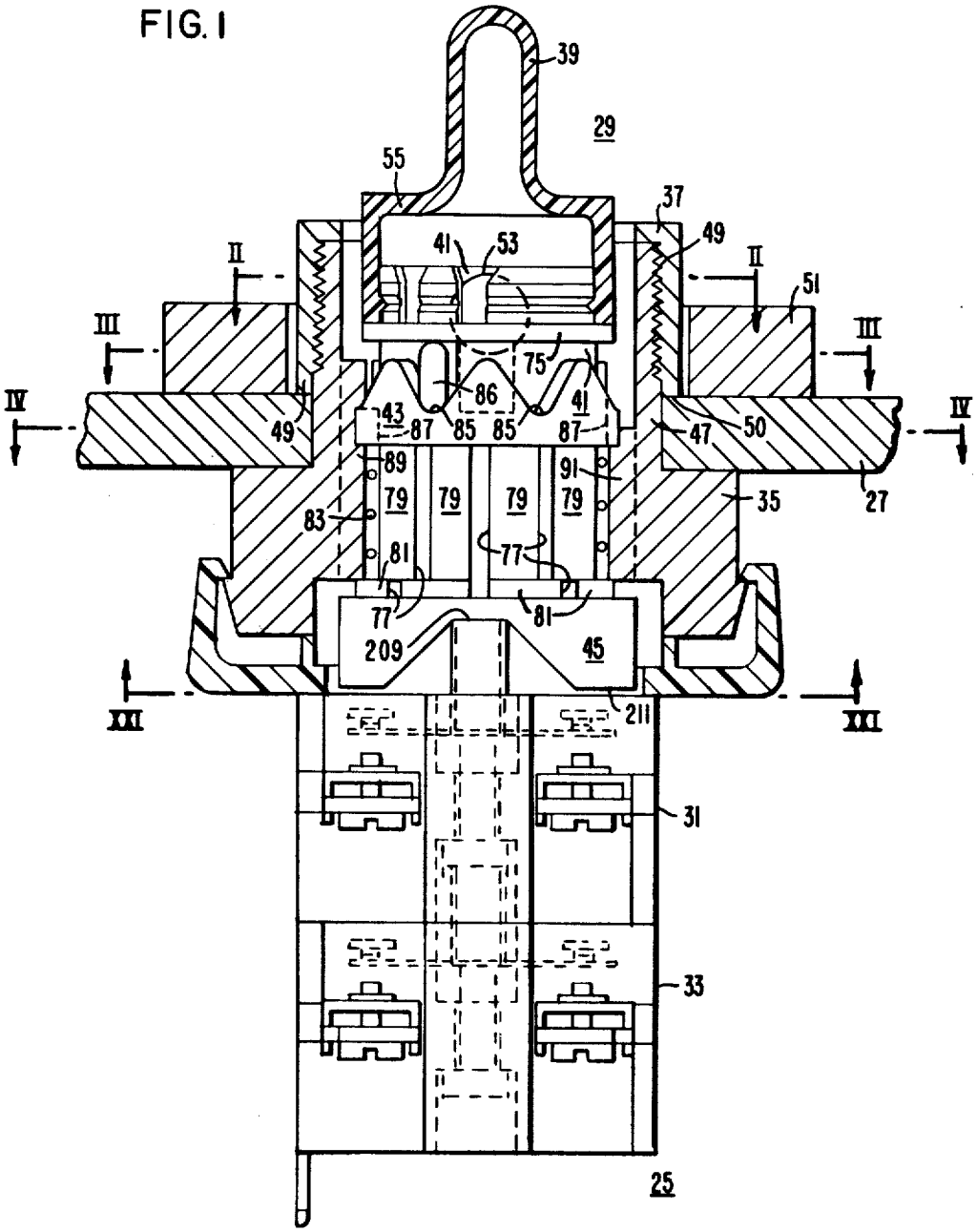
FIG. 1 is a vertical sectional view partly in elevation of a switch embodying the principal features of the invention.
Figure 2:
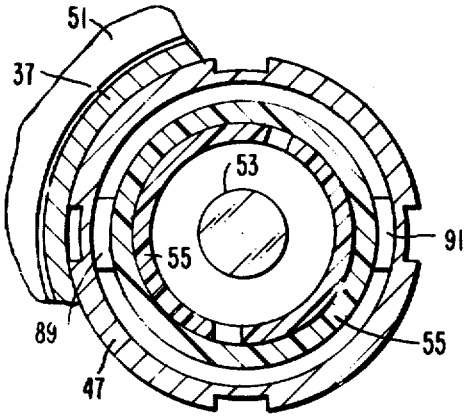
FIG. 2 is a horizontal sectional view taken on the line II—II of FIG. 1.

In FIG. 1 a switch is generally indicated at 25 and is mounted on a panel 27. The switch 25 comprises an operating unit 29 and pairs of contact blocks 31, 33 in tandem. The operating unit 29 comprises a housing 35, a clamp ring 37, a handle or actuating knob 39, a contact actuator 41, detent means or detent cam 43, and an operating cam 45. The housing 35 is a tubular member including a reduced portion 47 which extends through an aperture in the panel 27 and which comprises a threaded upper end portion 49 on which the clamp ring 37 is tightened for engagement with the panel at 50. A legend plate 51 is disposed on the panel 27 and around the clamp ring 37.

The handle 39 is composed of an electrically insulating material and is preferably translucent to transmit light from a light source or bulb 53. The handle 39 comprises a tubular portion 55 which is detachably mounted on the upper end of the contact actuator 41. As shown more particularly in FIG. 5, the tubular portion 55 comprises an end surface 57 and a pair of ears 59, 61 extending radially inwardly from the inner surface of the portion 55 and having end surfaces aligned with the end surface 57. The ears 59, 61 are not diametrically opposed, rather the arc between them on one side is greater than on the other. In addition, the tubular portion 55 includes a first pair of outwardly extending stop ribs 63, 65 having end portions 64, 66 which project beyond the end surface 57. The circular arc between the ribs 63, 65 on one side is greater than the arc on the other side thereof. Finally, the tubular portion 55 also includes a second pair of stop ribs 67, 69 which are wider than the ribs 63, 65, and which project beyond the end surface 57 by a distance 71 equal to that of the ribs 63, 65. The tubular portion 55 also has spaced notches 73 to permit contraction of the portion 55 as it is snapped into and out of place on the contact actuator 41 when repositioning the handle from one mode to another.

Figure 3:
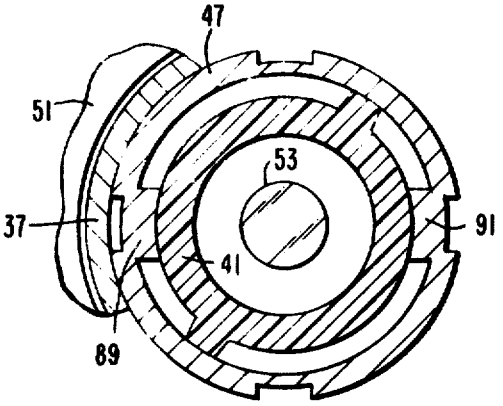
FIG. 3 is a horizontal sectional view taken on the line III—III of FIG. 1.
Figure 4:
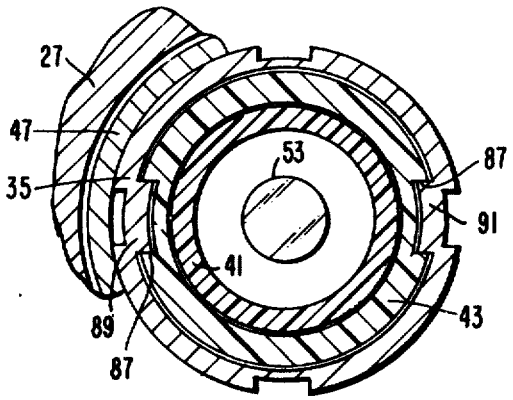
FIG. 4 is a horizontal sectional view taken on the line IV—IV of FIG. 1.

The contact actuator 41 (FIG. 5) has an upper end portion which is annular and includes a radial flange 75, as well as a lower portion which is splined, that is, it comprises a plurality of peripheral spaced grooves or slots 77 which form a number of longitudinal members 79, the lower ends of which include outturned flanges 81. The detent cam 43 is annular and is mounted on the lower portion of the contact actuator 41 where it is movable against a coil spring 83 (FIG. 1) between the actuator 41 and the housing 35. The detent cam 43 (FIG. 5) includes a plurality of spaced cam notches 85 in which a pair of diametrically opposite cam detents 86 (one of which is shown) operate. The cam detents 86 are part of the actuator 41 and project radially therefrom. The detent cam 43 also includes a pair of diametrically opposite grooves or notches 87 (one of which is shown) in which opposite cam guides or guide ribs 89, 91 are located, which guides extend longitudinally upon the internal surface of the housing 35 and enable the detent cam 43 to move longitudinally without rotating. The guides 89, 91 are also shown in FIGS. 3 and 4.

Figure 5:
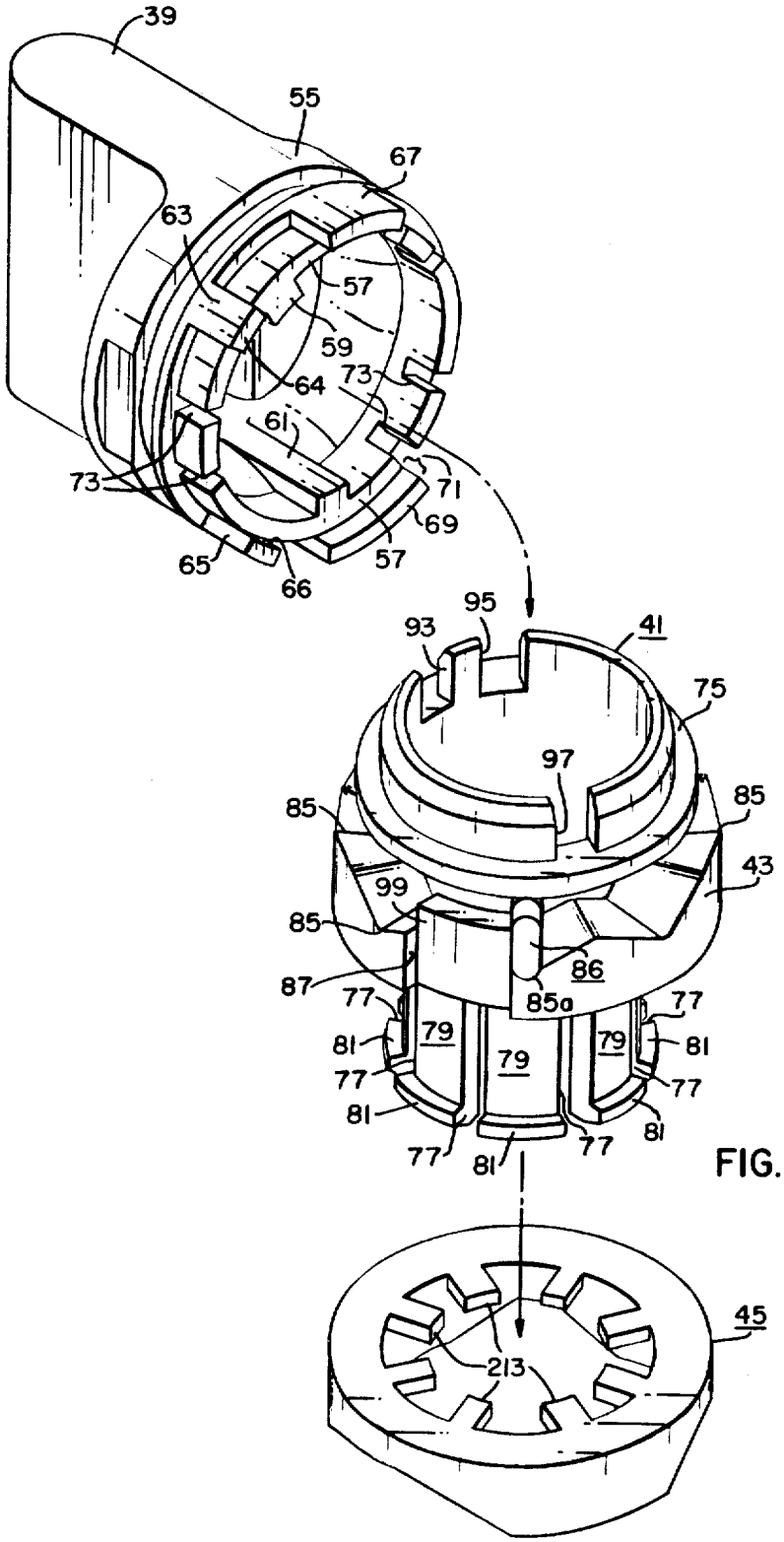
FIG. 5 is an exploded view of the operating members of the switch.

As shown in FIG. 5, the upper end of the contact actuator 41 comprises a plurality, such as three, notches 93, 95, 97 in which the ears 59, 61 are detachably located, depending upon whether the switch is operated in two, three or four modes or positions. For example, to turn the switch between two modes, the ear 59 is disposed in the notch 95 with the ear 61 in the notch 97. To operate the switch in three modes, the ear 61 is located in the notch 93, while the ear 59 is in the notch 97. To operate the switch in four modes, the ears 59, 61 may be in either notch 93, 95, or 97 because, as explained below, the end portions 64, 66 corresponding to the projection distances 71 of the several ribs 63, 65, 67, 69 are removed.

Figure 6:
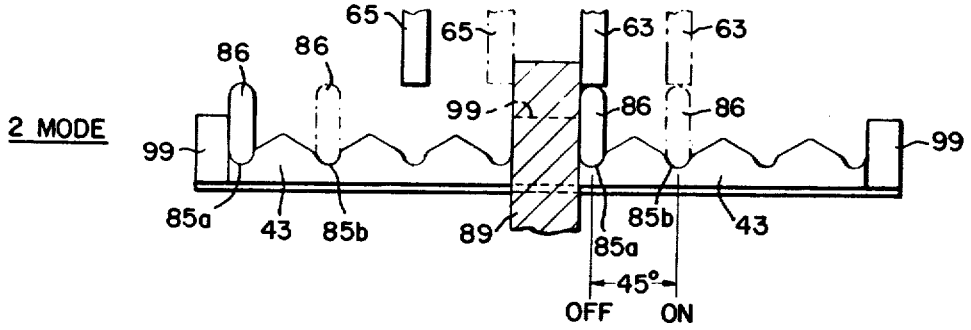
FIG. 6 is a development showing the profile of the operating cam when the switch functions in two modes.
Figure 7:
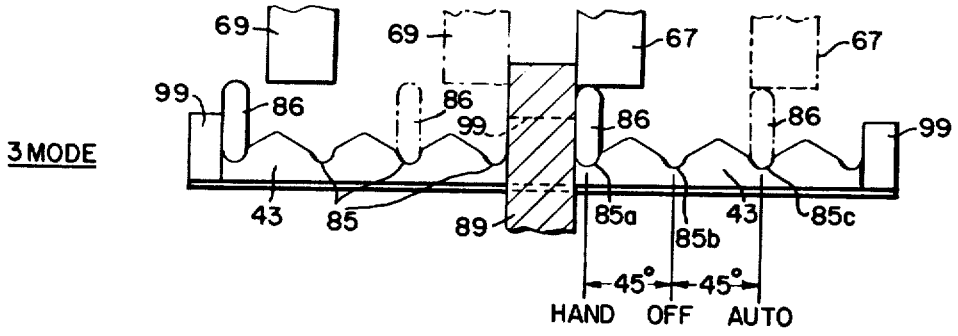
FIG. 7 is a development showing the profile of the cam when the switch functions in three modes.
Figure 8:
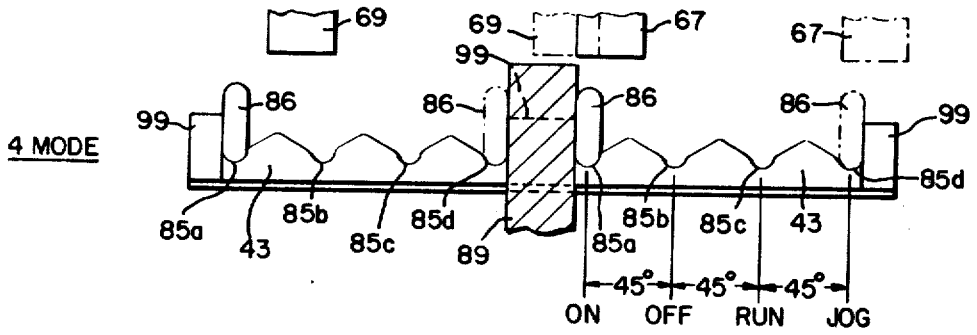
FIG. 8 is a development showing the profile of the cam when the switch functions in four modes.
Figure 9:
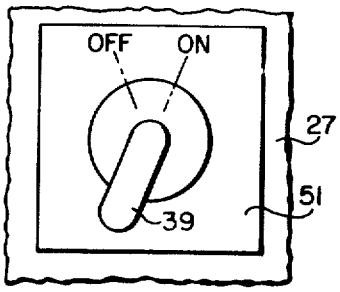
FIGS. 9, 10 and 11 are elevational views of various legend plates with which the switch handle may be used.

In accordance with this invention the switch 25 is operated through the two, three, and four modes as shown in FIGS. 6, 7, and 8, respectively. For two modes (FIG. 6) the handle 39 is rotated to turn the actuator 41 and the cam detents 86 from specific notches 85*a* to notches 85*b*, whereby the handle turns from OFF to ON, as shown in FIG. 9. The ribs 63, 65 limit the movement of the handle because in the OFF position, the rib 63 abuts the upper end of the guide 89; and in the ON position the rib 65 abuts the guide 89 on the opposite side thereof. Accordingly, the ribs 63, 65 in cooperation with the guide 89 limit movement of the handle between two positions ON and OFF, when the ears 59, 61 are properly disposed in the corresponding notches 95, 97.

Figure 10:
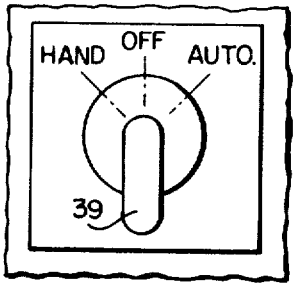

For three mode operation, the handle 39 is repositioned with respect to the notches 93, 97 so that the stop ribs 67, 69 are in the solid line positions as shown in FIG. 7, whereby the rib 67 is in abutment with the upper end portion of the guide 89 so that the handle moves the detents 86 from notches 85*a* to notches 85*b* and subsequently to notches 85*c*. Thus, the stop ribs 67, 69 move from the solid line positions to the broken line positions until the rib 69 confronts the other side of the guide 89. Thus, as shown in FIG. 10, the handle may be turned between the positions HAND, OFF, and AUTO.

Figure 11:
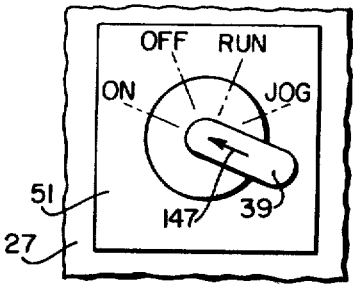

To operate the switch in four modes, the lower end portions 71 (FIG. 5) of the several ribs 63, 65, 67, 69 are removed or cut off so that none of the ribs confront the upper end portion of the guide 89 as shown in FIG. 8. Accordingly, when the handle 39 is rotated, the detents 86 move between the four notches 85*a*, 85*c*, 85*d* where they are limited by the guide 89. In addition to the guide 89, a portion 99 of the detent cam 43 (FIG. 5) projects into the path of the cam detents 86 on diametrically opposite sides of the cam and align with the guides 89. Accordingly, as shown in FIG. 11, the handle 39 may be rotated between the four positions including ON, OFF, RUN, JOG.

Figure 12:
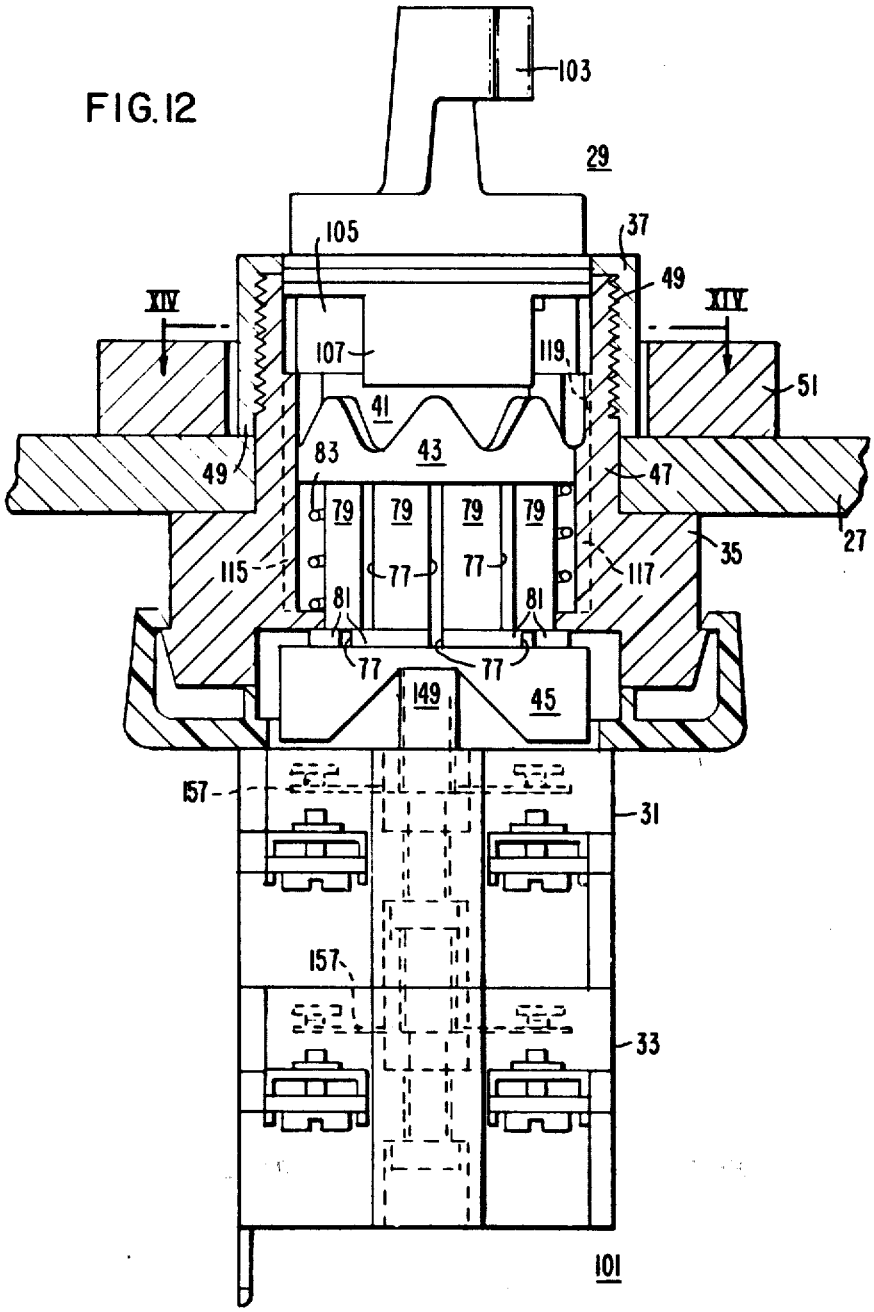
FIG. 12 is a vertical sectional view partly in elevation of another embodiment of the switch.

Another embodiment of the switch is generally indicated at 101 in FIG. 12 in which, for simplification, similar reference numbers refer to similar parts shown in FIG. 1. The operating unit 29 comprises a handle 103 which includes a tubular portion 105 and stop means comprising a projection or flange 107 extending from one side thereof. A tab 109 (FIG. 13) projects from the tubular portion 105 and is peripherally spaced from a radial flange 111 which space is less on one side than on the other; that is, the tab 109 and the radial flange 111 are not diametrically opposed. The tab 109 preferably includes an indicator mark, such as an arrow 113. The reduced portion 47 of the housing 35 (FIG. 12) includes a pair of diametrically opposed guides or guide ribs 115 and 117 which are substantially similar to the guides or guide ribs 89, 91 (FIG. 1), but which differ therefrom in that the guide 117 has a lower surface 119 (FIG. 14) and a projection 121 extending to the level of the upper end of the guide 115. The projection 121 includes stop edges 123 and 125 for limiting rotation of the handle 103.

The contact actuator 41 (FIG. 13) is provided a plurality, such as three, tab-receiving notches 127, 129, 131 facing the top surface of the actuator, as well as three slots 133, 135, 137. When the tab 109 is placed in one of the notches 127, 129, 131, the radial flange 111 fits into one of the corresponding slots 133, 135, 137. Accordingly, when the handle 103 is rotated, the force of turning is shared by the tab 109 and the flange 111. To facilitate placement of the tab 109, the indicator mark 113 is placed in the appropriate notch having the desired mode or position number, such as 2, 3, 4, as shown.

Figure 14:
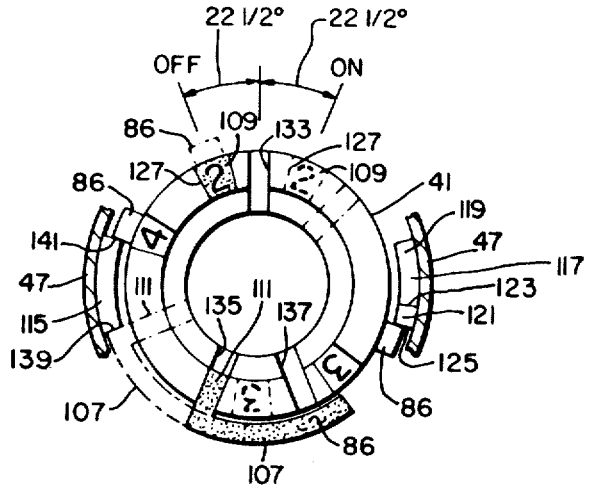
FIG. 14 is a horizontal sectional view taken on the line XIV—XIV of FIG. 12.
Figure 15:
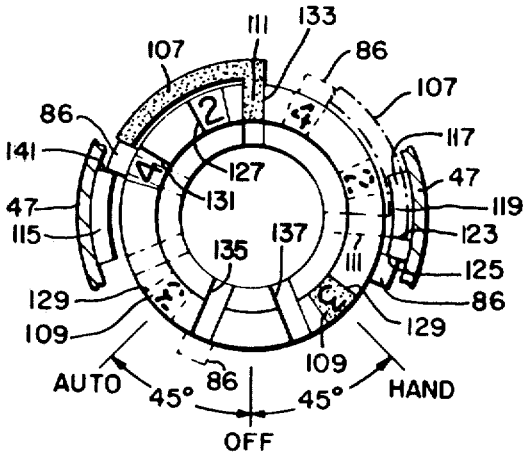
FIGS. 15 and 16 are alternate positions of the switch as shown in FIG. 14.
Figure 16:
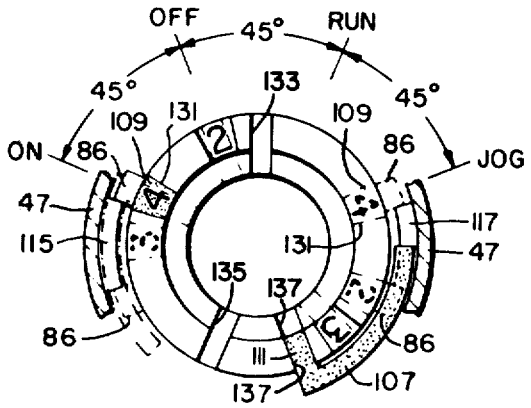
Figure 18:
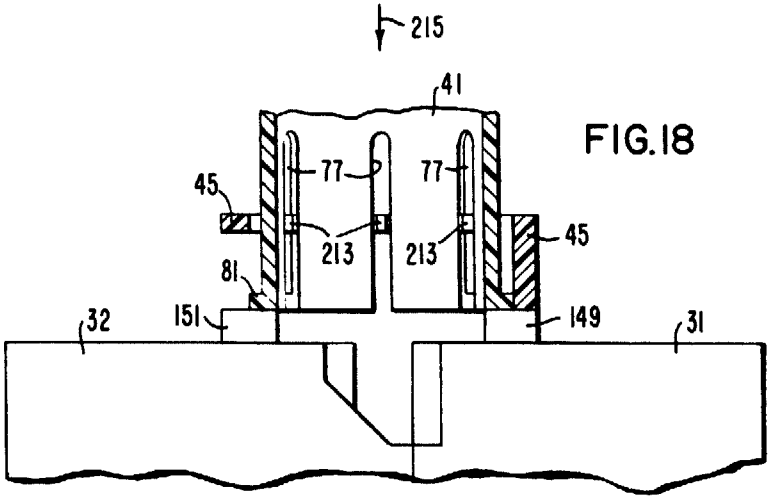
FIGS. 17, 18, 19, and 20 are fragmentary vertical sectional views, partly in elevation, showing various functions of the actuator.
Figure 20:
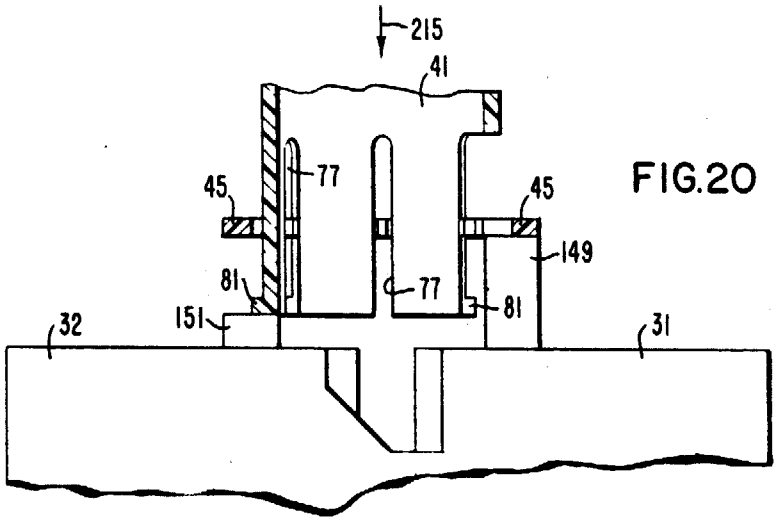

The manner in which the several parts of the handle 103 and the notches and slots of the contact actuator 41 operate is shown in FIGS. 14, 15, 16. For two-mode operation (FIG. 14), the tab 109 is placed in the notch 127 having the identification "2" with the radial flange 111 fitting into the slot 135, whereby the flange 107 is disposed over a peripheral sector of the actuator 41. To illustrate the several parts 107, 109, 111 in FIGS. 14, 15, 16, these parts are indicated by stippling which has no reference to the kind of material involved. Thus, the handle 103 is rotated between the OFF and ON positions, as shown in FIG. 9, with the flange 107 moving to the broken line position (FIG. 14), the tab 109 and notch 127 moving to their respective broken line positions, and the detent cam 86 moving to its broken line position. In the broken line position of flange 107 no further rotation is possible because the flange 111 strikes the guide 115 at the surface 139. When the handle is rotated in the reverse direction, the cam detent 86 strikes the guide 115 at the stop surface 141, and the diametrically opposite detent cam 86 strikes the stop edge 125 of the projection 121 simultaneously.

For three-mode operation (FIG. 15), the tab 109 and the flange 111 are placed in the notch 129 and slot 133, respectively, which notch is identified with the number "3". In that position, the cam detents 86 are against the stop surfaces 125 and 141; and the handle is rotated clockwise from a first position A to a second position B, or to a third position C through arcs of appropriate angles, such as 45 degrees each. When the tab 109 reaches the broken line position 109, the flange 107 strikes the stop surface 123 and prevents further rotation. As the flange 107 approaches the stop surface 123, it clears the surface 119 of the guide 117.

Figure 13:
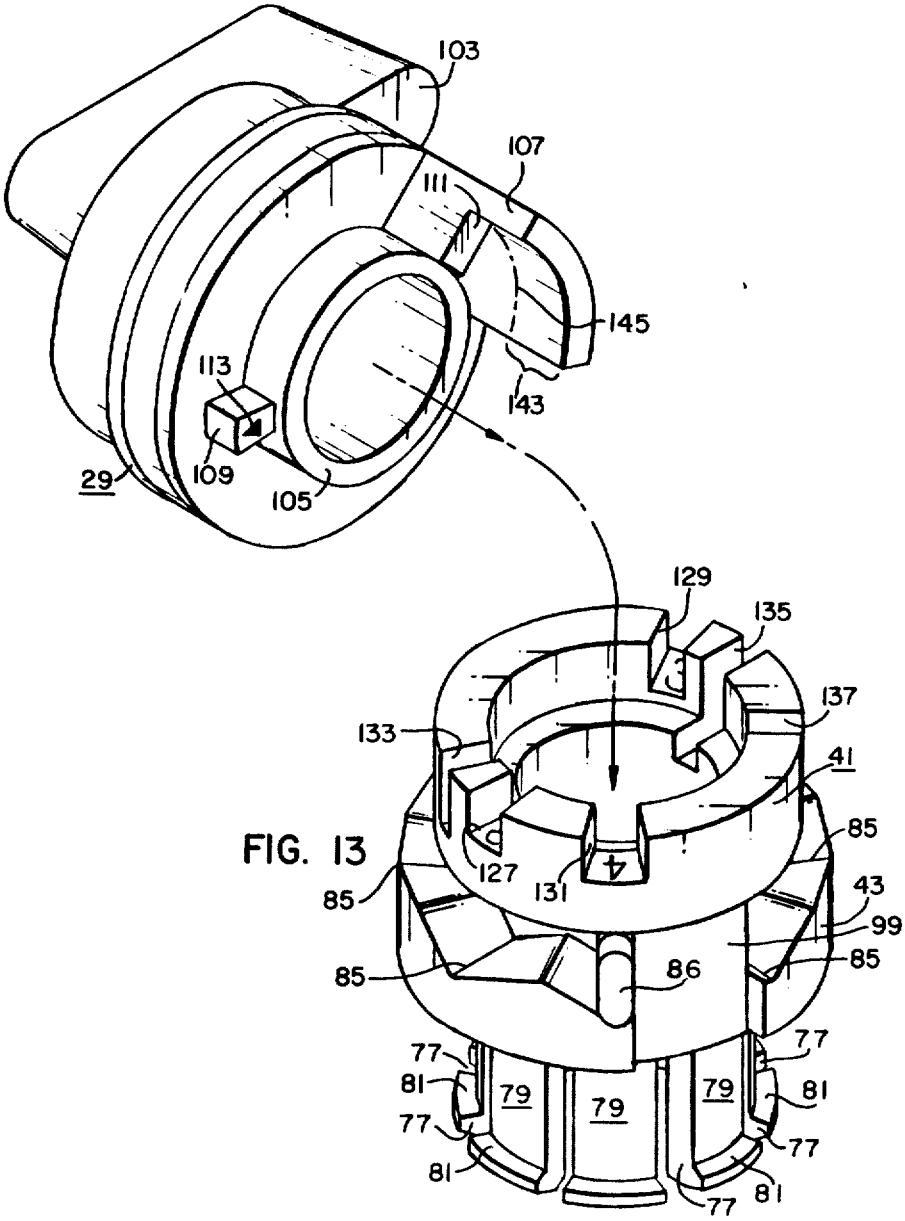
FIG. 13 is an exploded view of the operating parts of the switch shown in FIG. 12.

When the operating unit 29 is used for four-mode operation, it is necessary to remove, such as by cutting, a lower portion 143 of the flange 107 along a line, such as indicated by the broken line 145 (FIG. 13). To facilitate removal of that portion, a breaking groove may be provided at the line 145. With the lower portion 143 removed, the flange 107 no longer collides with the projection 143 when the handle is rotated. However, the tab 109 and the flange 111 are preferably placed in the notches 131 and slot 137, respectively, so that an indicator, such as an arrow 147 (FIG. 11) points to the appropriate position, such as ON, OFF, RUN, JOG, on the legend plate 51. The limits to the rotation of the operating unit 29 are then provided by the cam detents 86 (FIG. 16) which are stopped when they collide with the guides 115, 117. In this manner, the handle is turned through four positions through three arcuate sectors of suitable degrees, such as 45 degrees, each, until the tab 109 and the notch 131 reached the broken line positions thereof.

Rotation of the operating unit 29 with either the embodiment of FIG. 1 or FIG. 12, rotates the operating cam 45 through the indicated modes to open or close the circuits through the contact blocks 31, 33. As the operating cam 45 is rotated, it actuates switch operating plungers 149, 151 in various combinations of UP and DOWN positions, depending upon the cam surface. The contact blocks 31, 33 may be disposed in tandem (FIG. 12) with at least two blocks in position. In addition, the blocks 31, 32 may be disposed in side-by-side positions (FIG. 22) with their respective plungers 149, 151 engaging the cam 43. Each contact block contains a pair of movable contacts 153 and a pair of stationary contacts 155. The movable contacts 153 are mounted on a bridging contact carrier 157 which in turn is mounted on the plunger 151 in a conventional manner, such as shown in U.S. Pat. No. 3,919,506. Each contact block is adjusted for either normally open (as shown) or normally closed conditions. Each contact block 31, 32, 33 includes a pair of similar contacts 153, 155, contact carrier 157, and plunger 151 or 149 which are disposed in a contact chamber 159 formed by a pair of opposite side walls 161, 162, opposite end walls 165, 167, as well as top and bottom opposite edge walls 169, 171. To facilitate assembly, the side wall 161 and end walls 165, 167 constitute a cover and are separable from the body portion which comprises the side wall 162 and the upper and lower edge walls 169, 171. When assembled, suitable means (not shown) maintain the cover and body portions intact.

Figure 22:
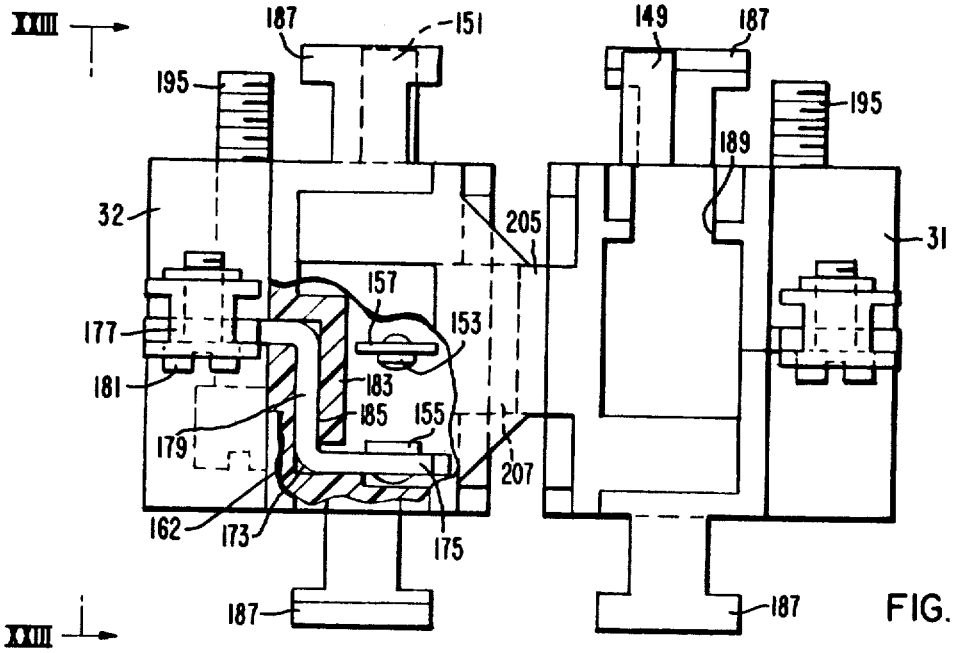
FIG. 22 is an elevational view with a portion broken away showing the relative positions of a pair of contact blocks.

As shown in FIG. 22, the stationary contacts 155 are mounted on a terminal connector 173 which has a generally Z-shaped configuration comprising an inner end portion 175, an outer end portion 177, and an intermediate portion 179. The outer end portion comprises an assembly of a terminal screw and clamp 181 to which a flexible conductor (not shown), such as a stranded wire, is attached.

In FIG. 22, the intermediate portion 179 is disposed between the side wall 162 and a wall portion or flange 183 which is spaced at 185 by a distance substantially equal to the thickness of the intermediate portion 179. The wall portion 183 is comprised of an electrically insulating material similar to the walls forming the several contact blocks 31, 32, 33 and serves as an insulating barrier to prevent any arc occurring between the contacts 153, 155 from moving from the stationary contact 155 to the intermediate portion 179, which is closer to the movable contact 153 when it is in the open position. Thus, the wall portion 183 facilitates in terminating any arc occurring during separation of the contacts.

Figure 24:
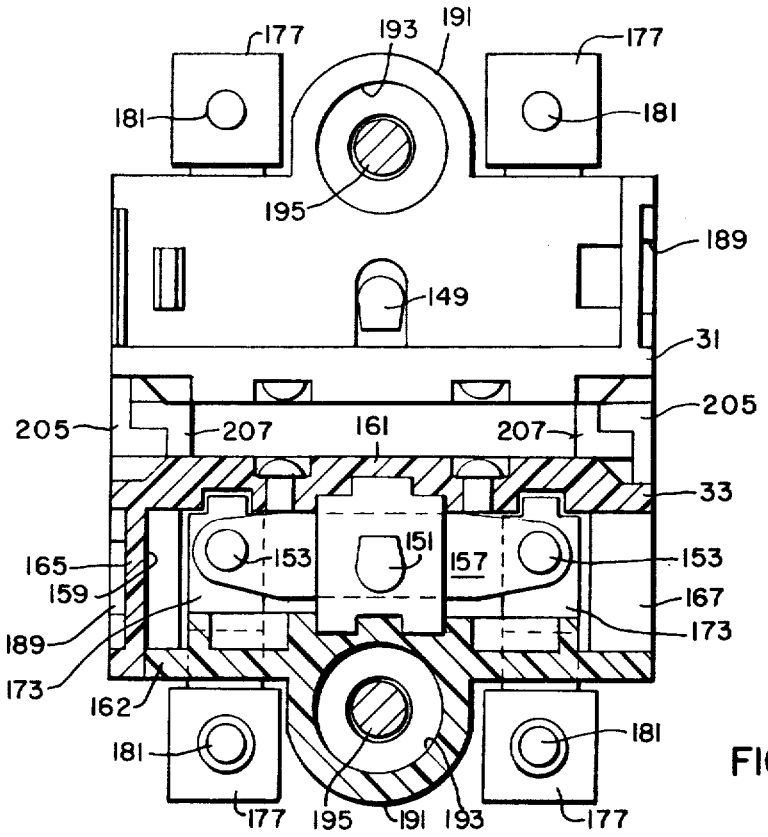
FIG. 24 is a horizontal view partly in section and partly in elevation taken on the line XXIV—XXIV of FIG. 23.

The terminal connectors 173 are retained in the position shown in FIG. 24 by the end walls 165, 167 when the body and cover portions are completely assembled.

Figure 23:
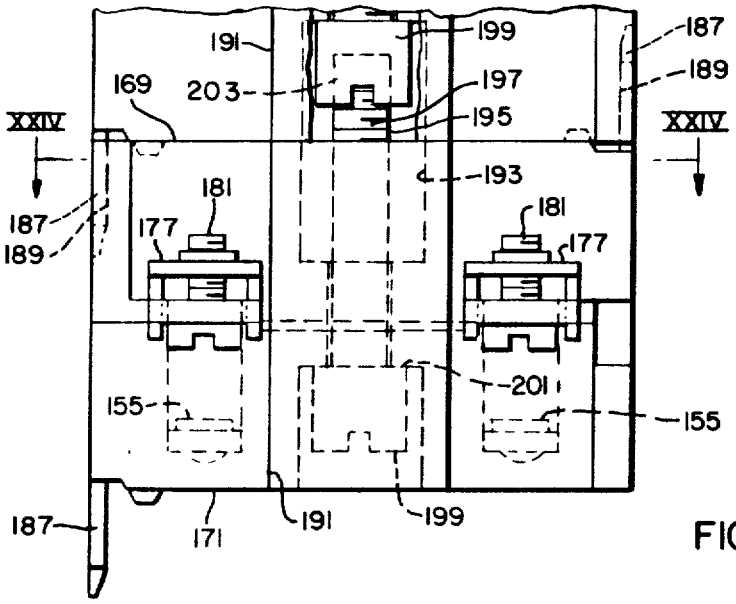
FIG. 23 is an end view taken on the line XXIII—XXIIIin FIG. 2 of a contact block with an additional upper contact block added in tandem.

Although the contact blocks 31, 32, 33 are provided with integral interfitting members including prongs 187, which engage cooperating recesses 189 to retain the blocks in tandem, the blocks are also provided with tubular portions forming bores 193 adapted to receive screws 195. Each screw 195 comprises a threaded shaft 197 and a head 199, which head engages a reduced shoulder surface 201 (FIG. 23). Each head 199 comprises a threaded bore 203 in which the end portion of the shaft 197 is secured to the next adjacent screw 195. The uppermost screws of a pair of tandem mounted contact blocks are attached in a suitable manner, such as to threaded apertures in the lower side of the housing 35.

When a sufficient number of contact blocks 31, 32, 33 are connected in tandem and secured in place by an elongated series of screws 195, the contact blocks of adjacent stacks or tandems are inclined to separate outwardly due to the force applied by the screws. As a result, adjacent pairs of contact blocks in the spaced tandem stacks are provided with laterally interconnecting means, such as cooperating hooks 205, 207, of which a pair extend from each pair of spaced blocks 31, 33 (FIG. 24). Thus, the hooks 205, 207 maintain a pair of tandem contact blocks in the desired spacing with respect to each other and in alignment with the operating unit 29.

Figure 17:
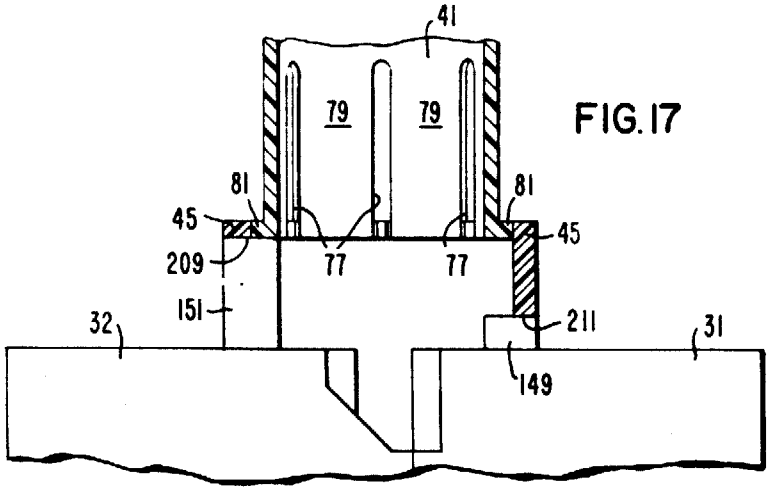
Figure 21:
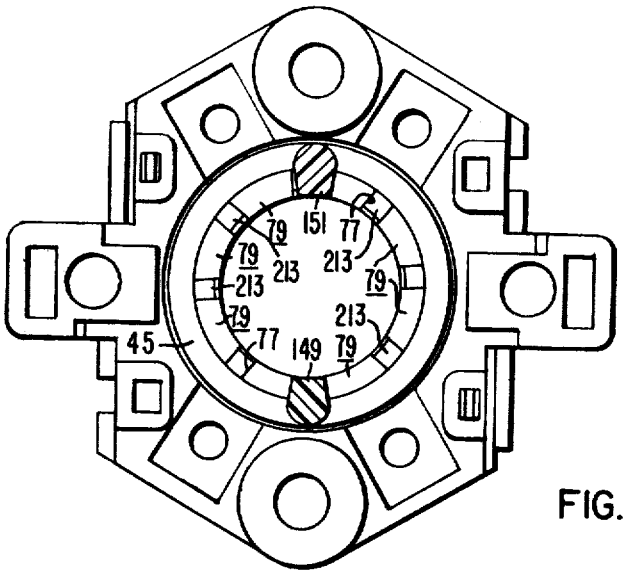
FIG. 21 is a horizontal sectional view taken on the line XXI—XXI of FIG. 1.

The manner in which the operating cam 45 is mounted on the lower end of the contact actuator 41 is shown in FIGS. 17–20. The cam 45 is an annular member having cam surfaces 209, 211 (FIG. 1) and mounting spokes 213 (FIG. 5). As shown in FIG. 21, the spokes are disposed in the grooves 77 between the several longitudinal members 79. Thus, when the contact actuator 41 is rotated, the cam 45 rotates to actuate one or both plungers 149, 151, such as shown in FIG. 17. However, where the handle 39 or 103 is operated as a push button instead of a rotary selector switch, the actuator is moved in the direction of the arrows 215 (FIG. 18) to depress both plungers 149, 151. The operating cam 45, however, remains in its position because the spokes 213 slide in the slots 77. As shown in FIG. 21, the upper ends of the plungers 149, 151 overlap the surfaces of the cam 45 and the flanges 41 at the lower end of each longitudinal member 79. Accordingly, the plungers 149, 151 are actuated by either or both of the cam and longitudinal members.

Figure 19:
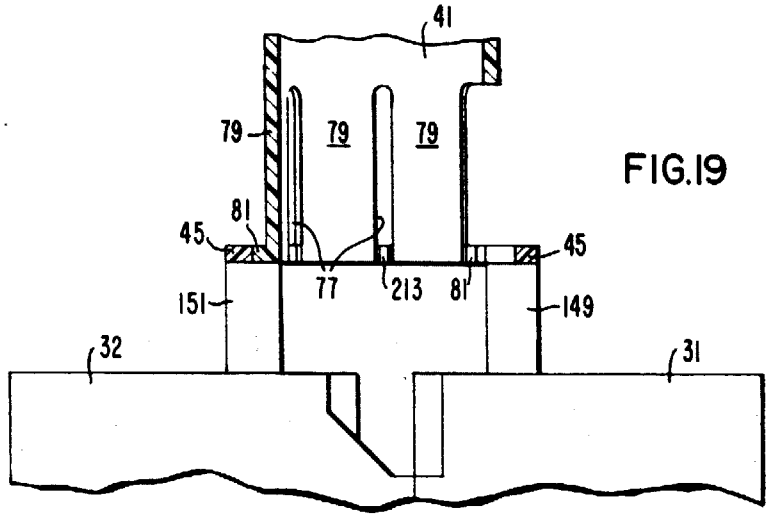

Finally, where necessary, one or more of the longitudinal members 79 may be eliminated, such as shown in FIG. 19 on the right-hand side, thereby removing one of the flanges 81 which overlaps the plunger 149. Thus, when the actuator 41 is depressed in the arrow 215 (FIG. 20), the plunger 151 is depressed, but the plunger 149 remains in the upper position.

What is claimed is:

1. A rotary selector switch comprising a rotatable actuating unit, a tubular housing, said unit comprising an actuator within the housing and a switch handle on one end of the actuator, at least two switch structures mounted on the housing and operatively connected to the other end of the actuator, the handle being at one end of the housing and rotatable through one limited sector thereof, the handle being removable from the actuator for repositioning thereon in another limited sector of rotation, mutually interfitting means on the handle and actuator to enable said removal and repositioning, stop means for limiting rotation of said unit and comprising interengageable means between the handle and the housing, the interengageable means on the handle comprising a first pair of peripherally spaced ribs that are rotatable through one limited sector for one position of the handle, the interengageable means on the handle also comprising a second pair of peripherally spaced ribs that are rotatable through another limited sector for another position of the handle, the interengageable means also comprising a pair of peripherally spaced guides on the housing, each rib having a stop surface on each side thereof and the peripheral spacing between the stop surfaces of each pair of ribs on one side being longer than the peripheral spacing between the stop surfaces of the ribs on the other side thereof, the interengaging means on the handle being located in the longer peripheral spacing when the handle is rotated through said one limited sector and located in the shorter peripheral spacing when the handle is rotated through said other limited sector, an operating cam on the other end of the actuator, each switch structure having a reciprocable contact operating member to effect opening and closing of a circuit through the switch structure, and the cam having cam operating surface means for actuating the contact operating members.

2. The switch of claim 1 in which the unit is rotatable between at least two switch positions in each sector of rotation.

3. The switch of claim 2 in which there are detent means between the housing and the rotatable actuating unit for holding the handle in a selected position.

4. The switch of claim 3 in which the detent means comprises a detent cam on one of the rotatable actuating unit and the housing and a cam follower on the other of said unit and the housing.

5. The switch of claim 4 in which the cam follower is on said unit, the detent cam is slideable longitudinally on and rotatable with the housing, and there are spring bias means for holding the detent cam longitudinally against the cam follower.

6. The switch of claim 6 in which there is an annular space between the actuator and the housing, and the detent cam and spring bias means are located in said space.

7. The switch of claim 6 in which the actuator is a sleeve.

8. The switch of claim 7 in which the sleeve has a spline and the operating cam includes projection means detachably mounted in the spline.

9. The switch of claim 6 in which the detent cam and the housing have mutually interfitting means including the ribs to enable longitudinal movement of the detent cam in the housing.

* * * * *